United States Patent [19]

Sloan

[11] Patent Number: 5,050,880

[45] Date of Patent: Sep. 24, 1991

[54] RANDOM DISTRIBUTION MACHINE

[76] Inventor: Randy Sloan, 3360 Kings Row, Reno, Nev. 89503

[21] Appl. No.: 569,177

[22] Filed: Aug. 17, 1990

[51] Int. Cl.[5] ..... A63F 9/00

[52] U.S. Cl. ..... 273/144 B

[58] Field of Search ..... 273/1 L, 129 AP, 269, 273/138 R, 138 A, 144 R, 144 B, 144 A; 446/178

[56] References Cited

U.S. PATENT DOCUMENTS

| | | | |
|---|---|---|---|
| 2,315,323 | 3/1943 | Fostos | 273/144 A |
| 3,095,655 | 7/1963 | Berglund et al. | 434/188 |
| 3,304,091 | 2/1967 | Bittner | 273/144 B |
| 3,534,964 | 10/1970 | Guill | 273/144 A |
| 3,679,211 | 7/1972 | Hartley | 273/144 B |
| 4,368,887 | 1/1983 | Gamble | 273/144 B |
| 4,508,346 | 4/1985 | Salvucci | 273/144 B |
| 4,786,056 | 11/1988 | Dunnigan | 273/144 A |
| 4,961,578 | 10/1990 | Chateau | 273/144 B |

FOREIGN PATENT DOCUMENTS

| | | | |
|---|---|---|---|
| 3614822 | 11/1987 | Fed. Rep. of Germany | 273/144 R |

*Primary Examiner*—Edward M. Coven
*Assistant Examiner*—William M. Pierce
*Attorney, Agent, or Firm*—Thomas M. Freiburger

[57] ABSTRACT

A machine for random distribution, particularly for use in a gaming machine such as a bingo type game, utilizes a plurality of lightweight spheres such as ping pong balls, in two colors such as black and white. The balls are contained between two parallel planes spaced apart slightly wider than one ball width, at least a part of the front plane being transparent. The space between the two planes is divided into a mixing section and a holding section, separated by a narrow channel which may be at the bottom of the machine. Motors in both sections create air movement in the respective sections so as to mix the balls in the mixing section and then lift the balls in the holding section, into a pattern or matrix of the black and white balls. The pattern of stationary balls reveals whether the player has won a game of chance such as bingo, wherein all balls of one color would be in a single line. In a preferred embodiment the blowers are arranged to exhaust air from both chambers or sections thus drawing a vacuum through the chamber. The air motors are activated alternatively.

5 Claims, 5 Drawing Sheets

FIG. 3
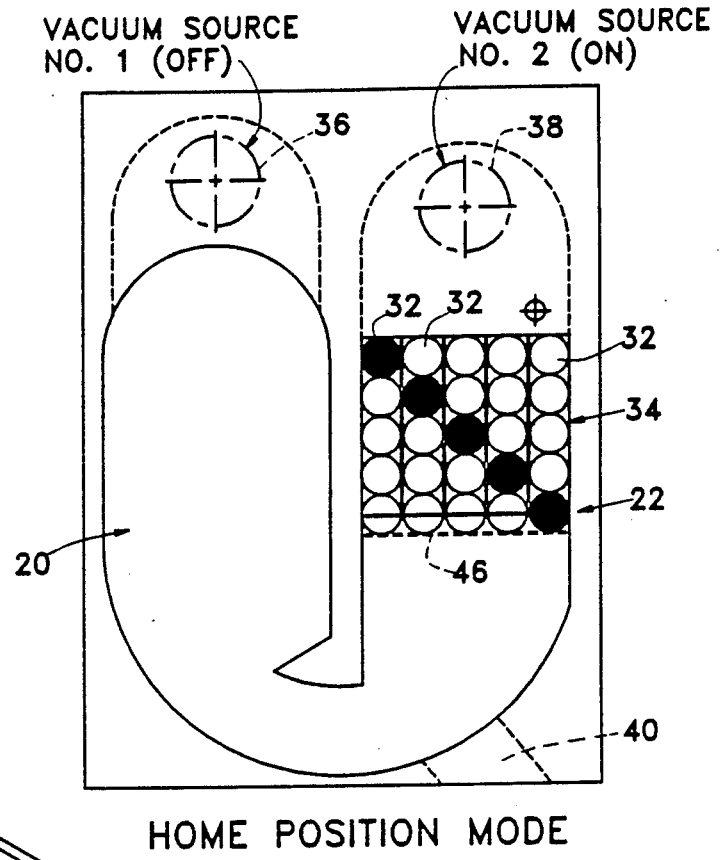
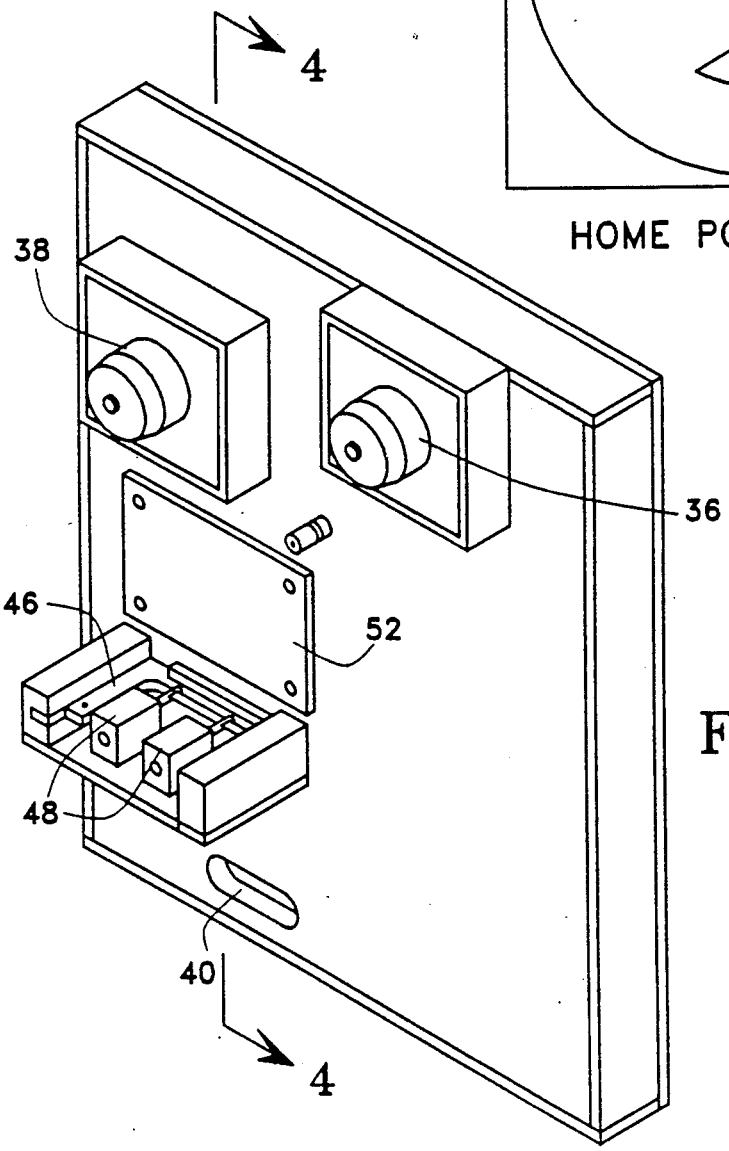
FIG. 5

RANDOM DISTRIBUTION MACHINE

BACKGROUND OF THE INVENTION

This invention is in the field of random distribution devices and machines, and in specific embodiments the invention relates to gaming devices wherein randomness of distribution of an entire population of articles or game pieces is desirable.

Particularly in the gaming industry, a great number of random sampling or random motion devices have been known. These include slot machines, roulette wheels, wheels of fortune and other such devices.

U.S. Pats. Nos. 3,095,655, 3,304,091, 3,423,872, 3,534,964, 4,368,887, 4,385,763, 4,508,346, 4,772,024, 4,796,890, 4,807,881, 4,822,048 and 4,824,113 all show various types of games or gaming devices involving skill or chance in moving small balls or similar items into various positions. A number of these patents show random selection devices which select a small group of marked balls from a larger group, in order to produce a random result. See, for example, Guill U.S. Pat. No. 3,534,964, Gamble U.S. Pat. No. 4,368,887 and Salvucci U.S. Pat. No. 4,508,346. Of these, the Guill patent shows a device with an upper plenum or chamber having a series of marbles with different colors or markings, with a plurality of vertical tubes below the plenum for receiving stacks of the marbles, apparently in random fashion. The marbles fall into the vertical tubes by gravity with fewer than all of the marbles permitted to enter the tubes. Games may be played with the winner determined by the pattern of marble colors arranged in the tubes.

The Gamble patent is similar, adapted to select a small set of balls randomly from a larger population of balls.

The Salvucci patent shows a somewhat different device in which a series of balls in a holding area are propelled upwardly by a stream of air from a motor driven blower. The balls are propelled into an upper tubular column where their order of arrangement is random. In most embodiments, Salvucci discloses capturing less than all of the available balls in the column; however, in one embodiment he discloses capturing a full complement of the balls randomly in the tubular column.

None of these previous devices was capable of randomly mixing, ordering and distributing all of a plurality of spherical game pieces into a two dimensional matrix, in an efficient, aesthetically pleasing and automated manner as in the present invention described below.

SUMMARY OF THE INVENTION

The random distribution machine of this invention is adapted to distribute randomly the entire population of a plurality of balls, some of which have markings different from the remainder. Although the device is especially suited for a game such as bingo or keno, wherein the position of various game pieces in a matrix determines whether a player wins or loses, it can also be used for other games and variations of these games.

The gaming device includes a housing formed of parallel plates, the spacing between which is adequate to accommodate only one width of a spherical game piece or ball, to establish a two-dimensional arrangement of the balls. The interior housing space includes a pair of chambers which are preferably arranged side by side, but which could be vertically separated if desired. The game pieces in a preferred embodiment comprise lightweight spheres such as ping pong balls, with the number of balls corresponding to that number which will fill a series of similar parallel vertical columns in one chamber, a holding chamber, wherein the balls arranged in a matrix.

The lightweight game balls are mixed up randomly in a first chamber or mixing chamber, by an air flow. The air flow can be a blower pushing a positive pressure against the balls, but more preferably it comprises a blower arranged in exhaust fashion, such that air is drawn into the mixing chamber from below and continuously and randomly moves the balls about in the mixing chamber.

After the balls have been stirred up and mixed in the mixing chamber, the mixing chamber blower is shut off and a second blower is activated, preferably above the ball-holding columns where the matrix of balls is to be distributed in the holding chamber. This creates an air flow which draws all of the balls from the mixing chamber through a relatively narrow channel into the holding chamber. The balls continue to move by suction created by the second blower and by air moving from the mixing chamber into the holding chamber. They are moved in random distribution fashion up into the ball-holding columns, into a matrix of rows and columns.

In the matrix, the entire population of balls is included. The balls having different markings from the rest will stand out. If they form a vertical, horizontal or diagonal line, this can indicate a winning matrix for the game of bingo.

Once all balls have been drawn up into the matrix, an increase in vacuum is detected by a vacuum sensor in or adjacent to the matrix, and this in turn activates a circuit which closes a gate below the matrix, i.e. below each of the open-bottomed columns. The gate holds all of the balls in place. The blower of the holding chamber is then shut off.

The number of balls of the population with the different markings can be varied, for games other than bingo. The game of keno can be played using an eighty ball population, with twenty being marked (colored) differently from the rest. The balls can be numbered, in addition to other surface indicia such as color, for certain games. More than two colors of balls can be used, for playing various other games involving arrangements of color or for adding more colors to games such as bingo.

For other game variations, the gate device which holds the population of balls in the matrix can be divided into a separately operable gate for each column. Thus, for each gate releasable manually by a player, second or further chances can be given to arrange balls in a certain fashion in each column, and this can be accompanied by higher-stakes play at each increment. Released balls can be re-mixed and then drawn back up into the columns or column remaining.

Accordingly, in one embodiment of the present invention a random distribution machine for mixing and randomly distributing a lightweight game pieces into a plurality of rows and columns includes a housing formed of a pair of parallel plates, with at least a portion of a front plate transparent for viewing by a user. A divider separates the interior housing space into a pair of chambers, preferably side-by-side, connected by a narrow channel between the chambers. Within the housing are a plurality of lightweight balls, with some of the balls having a different surface marking from the remainder of the balls so as to be distinguishable by a user viewing the balls through the transparent portion. A first air movement means in one of the chambers, a mixing chamber, moves the balls randomly in the mixing chamber when activated.

In the other chamber, a holding chamber, are a series of vertical stacking spaces for the balls, to receive the balls in parallel columns so as to form a matrix including all of the balls. Also in the holding chamber is a second air moving means, for moving air in such a direction so as to move the balls in random arrangement into the matrix. Once all of the balls have entered the matrix, a means is activated for retaining the balls in the matrix, even after the second air moving means is shut off. Electronic sensors and a connected processor determine the positions of the balls in the matrix, for example by light/dark analysis. This determines whether a player has won a game.

It is therefore among the objects of the invention to provide a simple and efficient random distribution device wherein air movements serve to stir up a plurality of lightweight game pieces, as well as to move the game pieces to a holding chamber after mixing, to randomly distribute all of the balls in a matrix wherein certain marked balls are identifiable within the matrix. These and other objects, advantages and features of the invention will be apparent from the following description of preferred embodiments, considered along with the accompanying drawings.

DESCRIPTION OF THE DRAWINGS

FIG. 3 is a view similar to FIG. 2, but showing the game pieces subsequently drawn from the mixing chamber into a holding chamber and up into a matrix of columns, under the influence of another air moving device.

FIG. 5 is a rear perspective view showing the back side of the random distribution machine.

DESCRIPTION OF PREFERRED EMBODIMENTS

Figure 1:
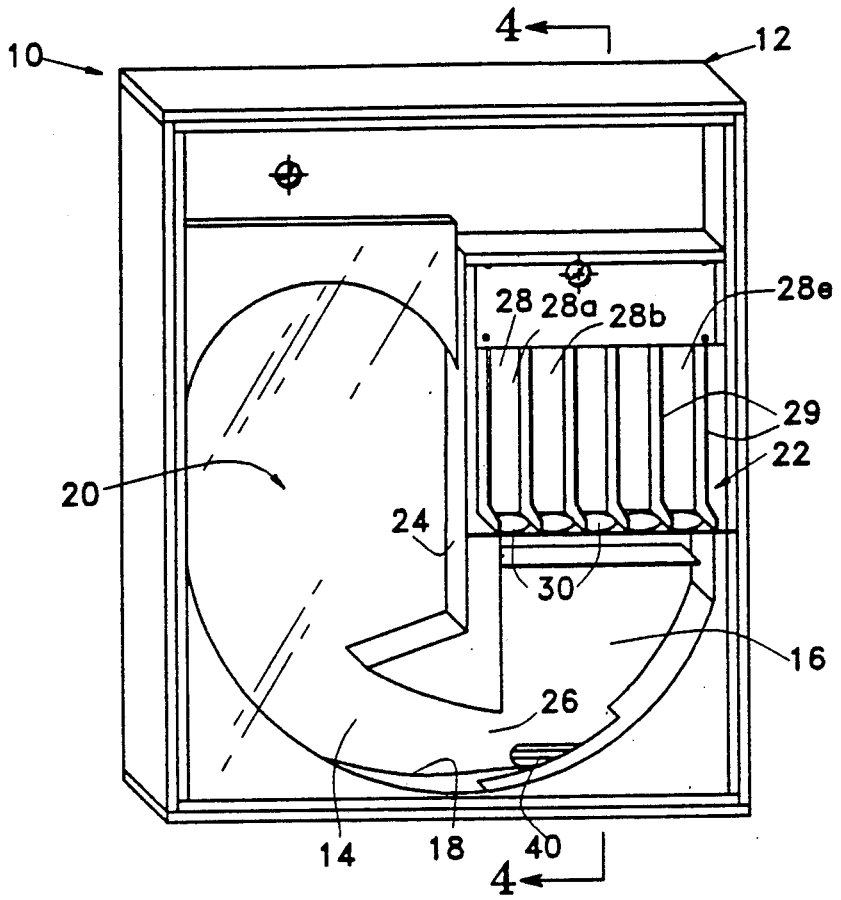
FIG. 1 is frontal perspective view showing a random distribution machine in accordance with the principles of the invention, but showing the apparatus with game pieces removed.

In the drawings, FIG. 1 shows a random distribution machine or apparatus 10 with principal components, but for clarity FIG. 1 eliminates game pieces which are contained in the apparatus as well as certain facia pieces and indicators which may be included but which are not important to the basic structure and function of the invention.

As seen in FIG. 1, the device 10 includes a housing 12 which has a front plate 14 and a back plate 16. The front plate 14 is transparent, at least in important areas, so that a user of the device preferably can view the movement of game pieces as they are mixed and then stacked in a random distribution.

The housing 12 thus defines an interior space or plenum 18 having a spacing which will substantially retain the game pieces in a two dimensional arrangement, i.e. the game pieces cannot be more than one deep in the space 18.

The interior space is divided into a pair of chambers —a mixing chamber 20 shown on the left in FIG. 1, and a holding chamber 22 shown on the right in FIG. 1. These two interior chambers or spaces are separated by a divider 24, which leaves only a relatively narrow channel 26 for communication of game pieces between the two chambers.

As also illustrated in FIG. 1, the holding chamber 22 includes a series of side by side game piece stacking columns or channels 28, which may include five columns 28*a* through 28*e*, separated by column dividers 29. At the bottom of each of these stacking spaces or columns or channels is a hole 30 of large enough diameter to easily pass a game piece between the stacking column and the space below.

Figure 2:
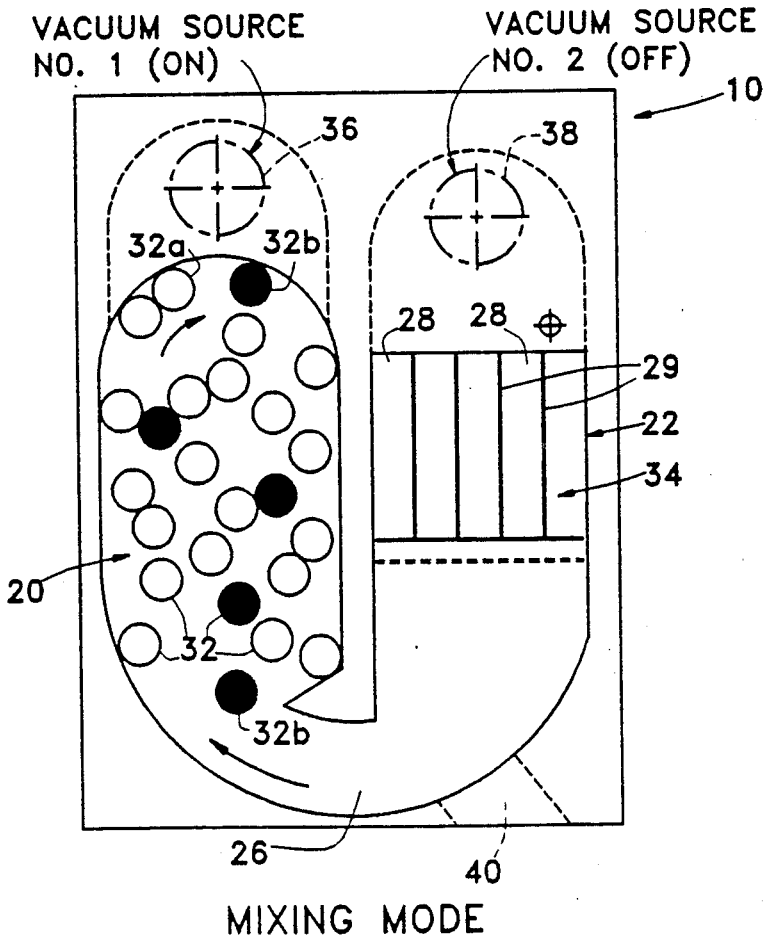
FIG. 2 is a somewhat schematic front elevation view showing the random distribution apparatus, with game pieces in a mixing chamber and under the influence of an air drawing blower.

FIG. 2 shows the apparatus or machine 10 with a multiplicity of lightweight spherical game pieces or balls 32 contained in the mixing chamber 20. These game pieces 32 may include spheres or balls 32*a* (such as ping pong balls) of one predominant color, and other spheres or balls 32*b* of a different color or surface indicia. Thus, the balls 32*a* may be white while balls 32*b* may be black, or vice versa, or otherwise with light-/dark contrast. In the example shown, a total of twenty-five balls 32 are included, and the ball receiving and stacking columns will thus include space for five of the balls in each column or stack 28, to ultimately provide a five ball by five ball matrix as shown in FIG. 3.

In FIG. 3 all of the balls 32 have been drawn up into the matrix area 34 to form a matrix of rows and columns as indicated. As mentioned above, one game which can be played with the apparatus of the invention is the game of bingo, and FIG. 3 shows one possible outcome for a winning bingo arrangement in the matrix 34.

Figure 4:
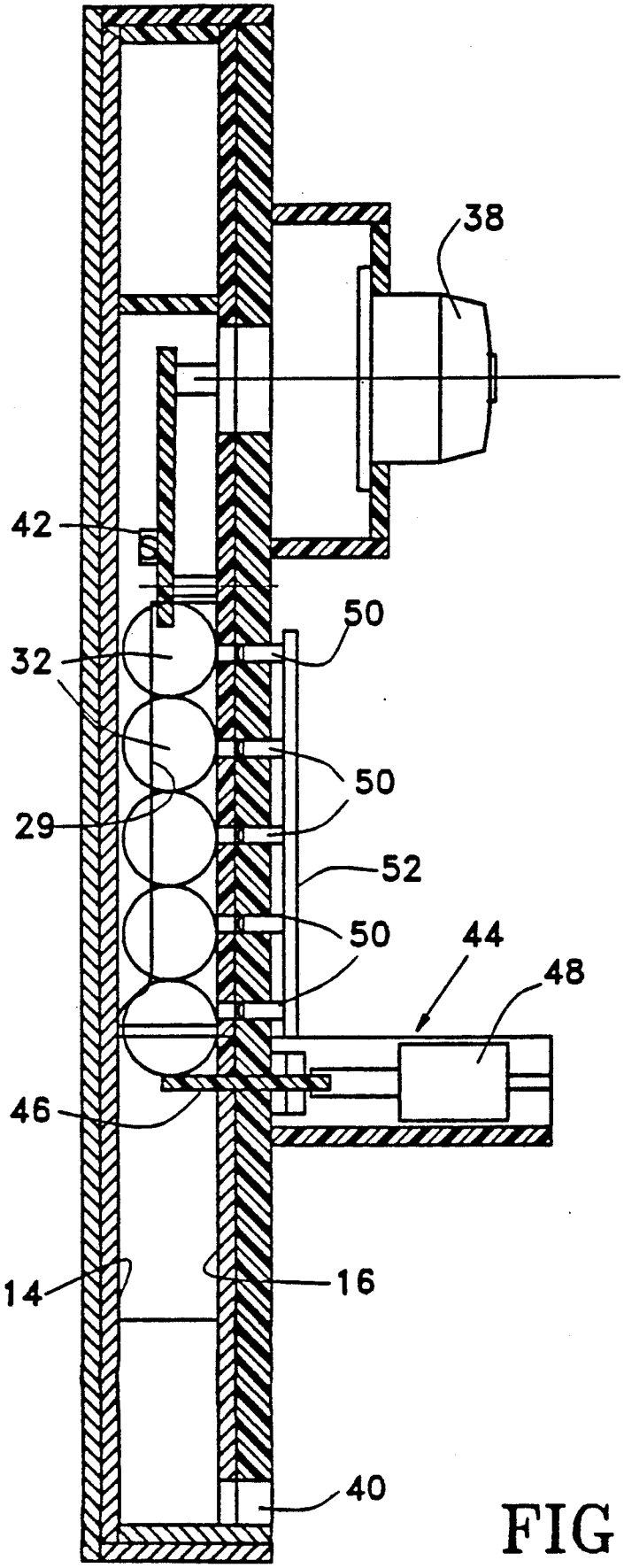
FIG. 4 is a sectional view in elevation of the machine, generally as seen along the line 4—4 in FIG. 1 or along the line 4—4 in FIG. 5.

FIGS. 2 and 3 indicate, and FIGS. 4 and 5 show more clearly, a pair of vacuum sources 36 and 38 each of which is associated with one of the chambers 20 and 22, respectively. These vacuum sources preferably comprise exhaust blowers, both of which when activated will draw air upwardly from the respective chamber and exhaust it from the machine. The blowers or vacuum sources in the preferred embodiment are not used simultaneously, but in the alternative. Each draws air into the machine through an outside air opening 40 which is indicated in both FIGS. 2 and 3 and which can also be seen in FIGS. 1, 4 and 5. In FIG. 4, a sectional elevation view, the vacuum source or blower 38 is seen in profile view.

When either of the blowers is activated, the narrow channel 26 between the two sections or chambers in combination with the opening 40 causes sufficient velocity to occur to move the balls between the chambers or within either of the chambers.

The mixing chamber or section shown on the left side of the drawings is constructed generally as shown such that when the mixing chamber blower 36 is powered and active the resulting air flow will cause the lightweight balls 32 to mix and rotate generally in a clockwise direction in the mixing chamber. This is indicated in FIG. 2.

On the other hand, when the mixing chamber blower 36 is turned off and the holding chamber blower 38 is powered and active, this will cause the balls to drop in the mixing chamber and pass through the narrow channel 26, entering the holding chamber 22. The upward air flow in the holding chamber continues to move the balls and lift them, until all balls 32 are contained within the columns or vertical channels 28 in the matrix 34 as shown in FIG. 3.

When all of the balls are thus contained in the matrix 34, the upward air flow into each of the columns is substantially restricted and nearly shut off. The channels are formed with relatively little additional space to cause this effect. At this point, a vacuum sensor 42 schematically indicated in FIG. 4 detects a higher level of vacuum in the holding chamber, i.e. in the columns 28 and/or the space above the columns, and this causes a gate device 44 to inject a gate 46 under the balls, thus supporting each column of balls in the position shown in FIG. 3 and FIG. 4. Immediately subsequent to this, the blower 38 is de-energized and shut off.

In one preferred embodiment the gate 46 may comprise a single plate which extends throughout the width of all columns. The plate may be spring-loaded toward the closed-gate or engaged position shown in FIG. 4, with a pair of solenoids 48 holding the plate 46 to a retracted position in all other instances (see also FIG. 5). The drawings are simplified to show basic structure and function, and the springs biasing the plate 46 toward the engaged position are not shown.

It should be understood that a series of individual, separate plates (not shown), one at the bottom of each column, may be substituted for the unitary plate 46 shown. In this case a separate solenoid 48 can be provided for each of the finger-like projections for each column. With an additional manual control button for each column, to retract the respective holding fingers or gates individually, this will enable the possibility of game variations, as explained above.

It should also be understood that the solenoids 48 can work in the reverse manner from what is described above. They can be spring-biased toward a retracted position, but extended into the gate-closed position by the powering of the solenoid or solenoids. It is generally preferably to have the gates biased toward the gate-closed position as first described, so that the game balls 32 can be left in an illustrative matrix 34 a in FIG. 3 during periods when no one is using the machine. This will enable the solenoids to be idle during the periods of non-use, thus establishing minimal power consumption during non-use.

FIG. 4 also shows one of the column dividers 29 which divide the matrix rack or space into the respective columns 28. The column dividers 29 are spaced only slightly wider than the outside diameter of a ball, so that the balls are guided into a neat and substantially vertical arrangement in each column. Also, FIG. 4 shows that the spacing between the front plate 14 and the rear plate 16 is only slightly wider than the outside diameter of a ball, e.g. approximately 5% or so wider, so that the balls are permitted to flow freely in the mixing chamber, between the chambers and into the matrix but o that they are absolutely prevented from any type of jamming.

FIG. 4 also shows sensors 50 at the back of the machine, extending into proximity with each of the balls 32 in the matrix. A sensor 50 is included at the position of each ball in the matrix, so that the light/dark identity or a color distinction of each ball can be determined, using circuitry further explained below. In a preferred embodiment the sensors 50 comprise transceivers, i.e. a LED type transmitter with phototransistor receiver. A back plate 52 behind the sensors 50 at the rear of the machine is also seen in FIG. 5.

Figure 6:
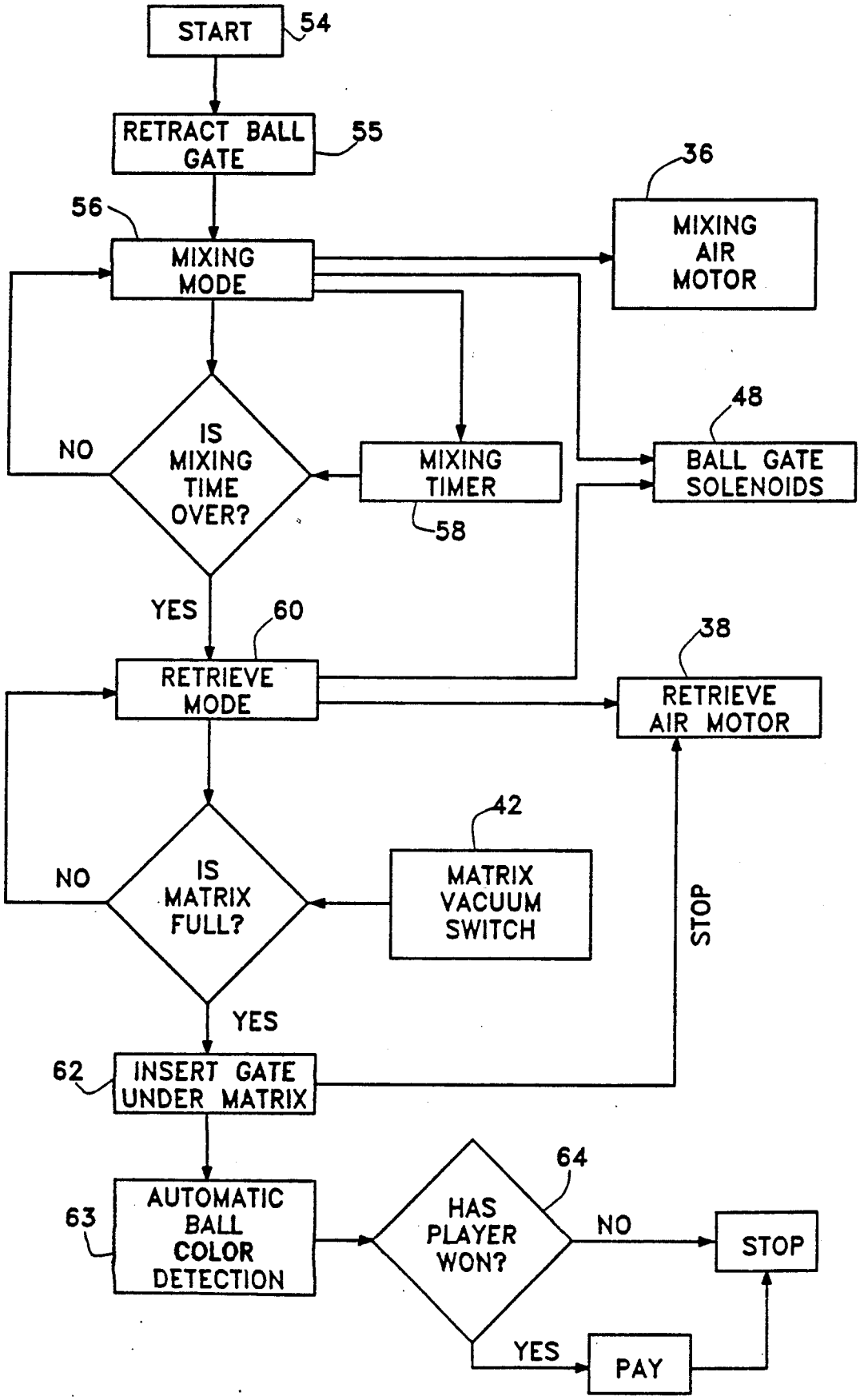
FIG. 6 is a simplified block diagram/flow chart indicating the operation of sensors, controls and air motors associated with the apparatus of the invention.

FIG. 6 indicates in a schematic flow chart/block diagram the manner in which the device is operated and the timing of actuation of the various electrical devices included in the machine.

In operation of the random distribution machine of the invention, a user first activates the machine by throwing a switch (not shown), dropping a coin, etc. "START" is indicated at 54 in FIG. 6. This causes the control circuitry to apply power to the ball gate solenoids, as indicated at 55 in FIG. 6, retracting the ball gate solenoids 48 to retract the ball gate 46. The balls 32 thus fall out of the matrix 34, and at this point power is applied to the vacuum source blower 36 at the top of the mixing chamber. This initiates the mixing mode as indicated at 56. FIG. 6 indicates a mixing timer 58 in a timing loop.

The air flow created by the blower 36 and by the narrow channel 26 creates sufficient air velocity and pressure to move the balls into the mixing section 20, then continues to cause the balls to mix and rotate around the mixing section as indicated in FIG. 2.

After a preselected time period has passed as indicated in the timing loop of FIG. 6, the control circuitry turns off the vacuum source blower 36 and applies power to the vacuum source motor 38, initiating the retrieve mode 60 as shown in FIG. 6. This causes the balls to stop rotating in the mixing chamber and to drop down and move through the narrow channel into the holding chamber. The balls continue movement up into the vertical columns 32 of the matrix rack, ultimately filling all of the columns. As each vertical column of the matrix is filled, the last ball in that column blocks off the air flow to that column. Balls do not tend to "stack" underneath a filled column, since another, not completely filled column will have a greater air movement and suction, and ultimately all of the balls will be drawn into the columns to properly fill the columns in a matrix 34 as shown in FIG. 3.

The last ball entering the matrix 34 substantially blocks off the air flow, or greatly restricts the air flow toward the vacuum source 38, so as to cause a change in pressure at the vacuum sensor 42. This change of pressure, as detected by the vacuum sensor, signals the control circuitry to remove power from the ball gate solenoids 48 and from the blower motor 38, as shown in the block 62 of FIG. 6.

Thus, in the retrieve mode, instead of being driven by a timing loop this mode continues until the matrix is full. With the matrix full, as indicated in FIG. 6, the play cycle is stopped.

The balls 32 are thus again in their "home" position, and may be examined by the user as to their distribution and individual position in the matrix. It can be determined whether a winning arrangement of balls has been generated in the matrix. Preferably this is automatically determined via the sensors 50 and circuitry explained below, and FIG. 6 indicates this with the block 63 and decision block 64.

In a gaming machine it is necessary to make an automatic determination as to what, if anything, the player has won. Additional plays or coins can be awarded, depending on the array of balls in the matrix 34.

Figure 7:
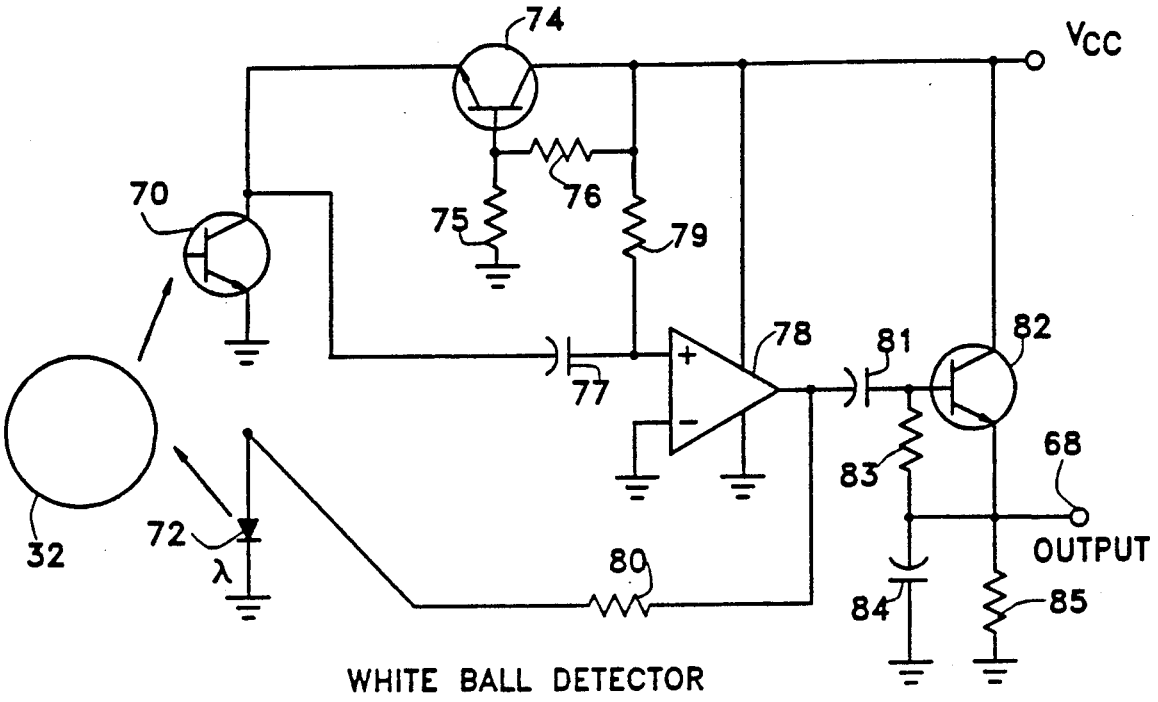
FIG. 7 is a schematic circuit diagram showing one example of a means by which light/dark ball differences can be detected in the system of the invention.

An example of a white ball detector circuit is shown schematically in FIG. 7. This circuit comprises a photon coupled oscillator and output stage that yields a TTL output (at output 68) when a reflective object (a white or light colored ping pong ball) is in front of the phototransistor 70 and light emitting diode 72. This circuit compensates for different ambient light levels, and will work reliably in total darkness or bright sunlight.

In the circuit, transistor 74 is configured as an emitter follower circuit. Resistor 75 and resistor 76 bias transistor 74 and phototransistor 70 to automatically compensate for different ambient light levels. The AC output of phototransistor 70 is coupled by capacitor 77 to the input of amplifier 78. Resistor 79 provides bias for the input. The output of amplifier 78 is used to drive the light emitting diode 72 through current limiting resistor 80.

The light emitting diode 72 and phototransistor 70 are physically arranged in a space of the ball matrix so that a reflective object in the space will return or "couple" the AC light signal from the light emitting diode 72 to the phototransistor 70. This AC signal is coupled by capacitor 77 to the input of amplifier 78 thus regenerating the output of amplifier 78 to comprise a photon coupled oscillator.

The AC output of amplifier 78 is coupled through capacitor 81 to the output stage, transistor 82. Transistor 82 is configured as an emitter follower with bias provided by resistor 83, capacitor 84 and resistor 85, so that an AC input will produce a DC output at output 68.

If there is no white ball or other reflective object in the space, the AC light signal will not be returned or "couple" and there will be no output. One white ball detector circuit is required for each space in the matrix.

The output at 68, from each ball position, can be fed to a simple processor or hard wired assembly (not shown) which will make the determination as to whether a "bingo" has been achieved, in the event the game of bingo is being played on the machine. The circuitry and processing for these functions can easily be carried out by those familiar with gaming machines and/or electronics, and these details do not form a specific part of the present invention.

Figure 8:
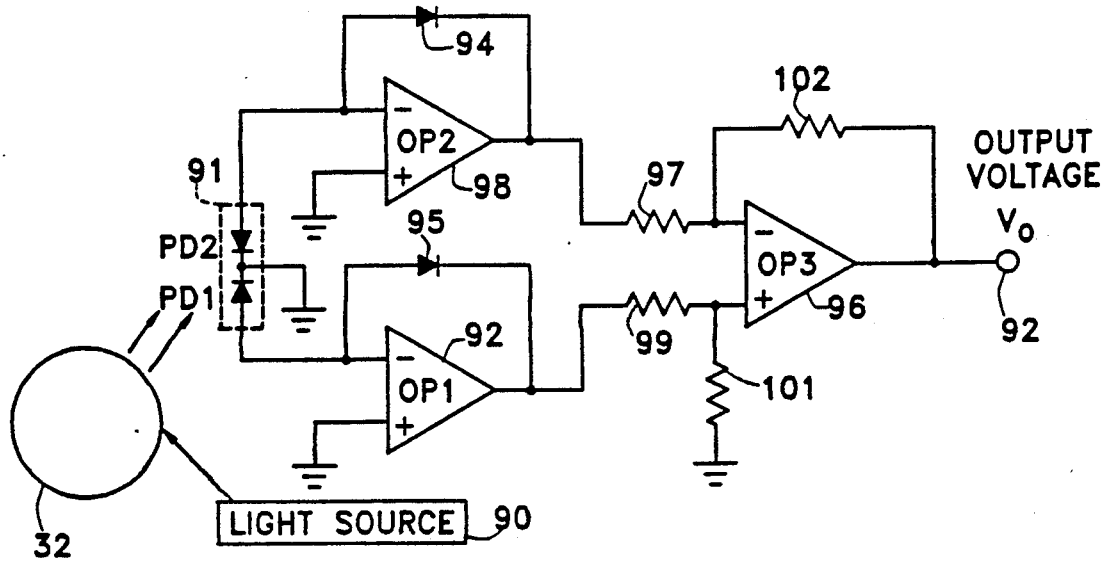
FIG. 8 is a schematic circuit diagram showing an example of a means for detecting color differences among balls of multiple colors.

FIG. 8 is another schematic circuit diagram, in this case showing color measurement for a machine having different colored balls. In this signal processing circuit, the light source indicated at 90 must supply visible as well as infrared light. The output voltage at the output 92 will correspond to the wavelength of the reflected light and will not change with the intensity of the light source. The circuit shown in FIG. 8 may use, as a semiconductor color sensor, Sharp Electronics Part No. PD153.

The semiconductor color sensor contains two photo diodes with different light wavelength response. The outputs of a semiconductor color sensor 91 are directly coupled to the inputs of two logarithmic biased amplifiers 92 and 98. Logarithmic bias is provided by diodes 94 and 95. The two outputs of the amplifiers 92 and 98 are connected differentially to amplifier 96 and resistors 97, 99, 101 and 102 provide bias so that the output of the amplifier 96 tracks the difference in the wavelength response of the semiconductor color sensor 91. The output may then be analog to digitally converted by a readily available A to D converter so that the digital signal may be logically compared to determine winning combinations.

The above described preferred embodiment is intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A random distribution machine for mixing and randomly distributing a plurality of lightweight game pieces into a matrix of rows and columns containing all of the game pieces, comprising, a housing formed by a pair of parallel plates, one being a front plate with at least a portion of the front plate transparent for viewing by a user, divider means separating the housing into a pair of chambers connected by a narrow channel between the chambers, namely a first or mixing chamber and a second or holding chamber, a plurality of lightweight balls contained in the housing between the parallel plates, the spacing between which is adequate to accommodate only one width of a ball game piece, to establish a two-dimensional arrangement of the balls, and the balls being capable of communication between the two chambers, with some of the balls having different surface marking from the remainder of the balls so as to be distinguishable by a user viewing the balls through the transparent portion, first air movement means in the first or mixing chamber, for moving the balls randomly, a series of vertical stacking spaces for the balls in the second or holding chamber, for receiving the balls in parallel columns so as to form a matrix including all of the balls, second air moving means in the holding chamber, for moving air in such a direction as to move the balls randomly into the matrix, and means for retaining the balls in the matrix after all of the balls have entered the matrix.

2. The apparatus of claim 1, wherein the two chambers are adjacent and side by side, with the narrow channel connecting the chambers at a bottom position, and wherein the first air moving means and the second air moving means each comprise exhaust air blowers tending to draw the balls upwardly, whereby the first air moving means, when activated, draws the balls upwardly and mixes them randomly in the mixing chamber.

3. The apparatus of claim 2, wherein the holding chamber comprises a plurality of vertical channels each only wide enough to hold the width of a single ball, and ball retaining gate means for engaging the balls below the matrix to hold them in the vertical channels after all of the balls have entered the matrix.

4. The apparatus of claim 3, including vacuum sensor means in the matrix, for sensing a decrease in pressure in the matrix after all balls have entered the matrix and have thereby restricted air flow into the matrix.

5. The apparatus according to claim 1, wherein the number of balls is just sufficient to fill the vertical stacking spaces in the matrix.

* * * * *